US009822530B2

(12) United States Patent
Reisdorff

(10) Patent No.: US 9,822,530 B2
(45) Date of Patent: Nov. 21, 2017

(54) UNDERGROUND VAULT ROOF SUPPORT

(71) Applicant: Laminated Wood Systems, Inc., Seward, NE (US)

(72) Inventor: Robert A. Reisdorff, Seward, NE (US)

(73) Assignee: LAMINATED WOOD SYSTEMS, INC., Seward, NE (US)

( * ) Notice: Subject to any disclaimer, the term of this patent is extended or adjusted under 35 U.S.C. 154(b) by 0 days.

(21) Appl. No.: 14/661,162

(22) Filed: Mar. 18, 2015

(65) Prior Publication Data

US 2015/0267424 A1 Sep. 24, 2015

Related U.S. Application Data

(60) Provisional application No. 61/954,833, filed on Mar. 18, 2014, provisional application No. 61/969,513, filed on Mar. 24, 2014, provisional application No. 62/088,753, filed on Dec. 8, 2014.

(51) Int. Cl.

| | |
|---|---|
| ***E04C 3/02*** | (2006.01) |
| ***E04C 3/30*** | (2006.01) |
| ***E04G 25/06*** | (2006.01) |
| ***E04G 25/04*** | (2006.01) |
| ***E04G 11/38*** | (2006.01) |
| ***E04G 11/48*** | (2006.01) |
| ***E04G 11/50*** | (2006.01) |
| ***E04G 17/16*** | (2006.01) |
| ***E04G 25/02*** | (2006.01) |

(52) U.S. Cl.

CPC ..... *E04C 3/30* (2013.01); *E04C 3/02* (2013.01); *E04G 11/38* (2013.01); *E04G 11/486* (2013.01); *E04G 11/50* (2013.01); *E04G 17/16* (2013.01); *E04G 25/02* (2013.01)

(58) Field of Classification Search

CPC ..... E04C 3/02; E04C 3/122; E04C 3/30
USPC ..... 405/288, 290
See application file for complete search history.

(56) References Cited

U.S. PATENT DOCUMENTS

| | | | | |
|---|---|---|---|---|
| 1,528,034 A * | 3/1925 | Thielmann | ..... | E21D 15/52 248/357 |
| 3,172,634 A | 3/1965 | Squire | | |
| 5,186,430 A * | 2/1993 | Ellithorpe | ..... | E04G 25/04 248/354.3 |

FOREIGN PATENT DOCUMENTS

| | | | | |
|---|---|---|---|---|
| DE | 416538 C * | 7/1925 | ..... | E21D 15/18 |

OTHER PUBLICATIONS

Smith, Anne. Adjustable Shoring Systems—Types available and how they work. Publication #C900921. Copyright, 1990. The Aberdeen Group.

* cited by examiner

*Primary Examiner* — Tara Mayo-Pinnock
(74) *Attorney, Agent, or Firm* — Reising Ethington P.C.; Eric Jones

(57) ABSTRACT

A shoring assembly for utility vaults. A crossbeam member is carried by a column member and a bracket is connected between the crossbeam member and the column member. The bracket supports the crossbeam member on the column member and comprises a jack member that is extendable upward to engage and move the crossbeam member upward relative to the column member into a support position against a vault roof to be shored.

18 Claims, 11 Drawing Sheets

UNDERGROUND VAULT ROOF SUPPORT

CROSS-REFERENCES TO RELATED APPLICATIONS

This application claims the benefit of the filing dates of U.S. Provisional Patent Application Nos. 61/954,833, filed Mar. 18, 2014; 61/969,513, filed Mar. 24, 2014; and 62/088,753, filed Dec. 8, 2014; each of which is incorporated herein by reference in its entirety.

STATEMENT REGARDING FEDERALLY SPONSORED RESEARCH OR DEVELOPMENT

Not Applicable

BACKGROUND

Field

This application relates generally to reinforcing or shoring reinforced concrete roofs of underground vaults.

Description of Related Art Including Information Disclosed Under 37 CFR 1.97 and 1.98

Subterranean vaults are used to house equipment related to utility operations such as electrical power transmission and sewer and storm water drainage. The reinforced concrete construction of such vaults must be strong enough to support all loads above them including loads from vehicle and/or pedestrian traffic. Subterranean vault roofs tend to lose or begin losing their strength after 30-60 years of service.

Adjustable shoring systems are known for use in supporting uncured concrete and formwork loads until the concrete cures sufficiently to become structurally self-supporting. Such systems include wood, aluminum or steel post shores, aluminum or steel scaffold-type frame shoring, aluminum or steel horizontal shoring, aluminum flying truss systems, steel column-mounted brackets, and steel friction collars. Some of these systems include screw jacks for adjusting the height of roof support elements.

SUMMARY

A shoring assembly is provided for supporting a reinforced concrete roof of an underground utility vault. The assembly comprises an elongated column member, and an elongated crossbeam member configured to be carried by the elongated column member in an orientation generally perpendicular to the column member and generally parallel to a utility vault roof to be shored. A bracket is connectable between the crossbeam member and the column member and is configured to support the crossbeam member on the column member. The bracket comprises a jack member extendable upward to engage and move the crossbeam member upward relative to the column member into a support position against a vault roof to be shored.

DRAWING DESCRIPTIONS

Figure 8:
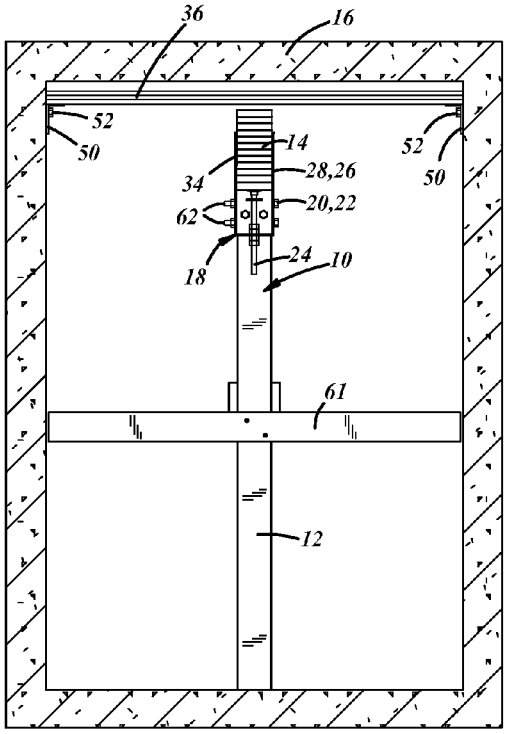
Figure 7:
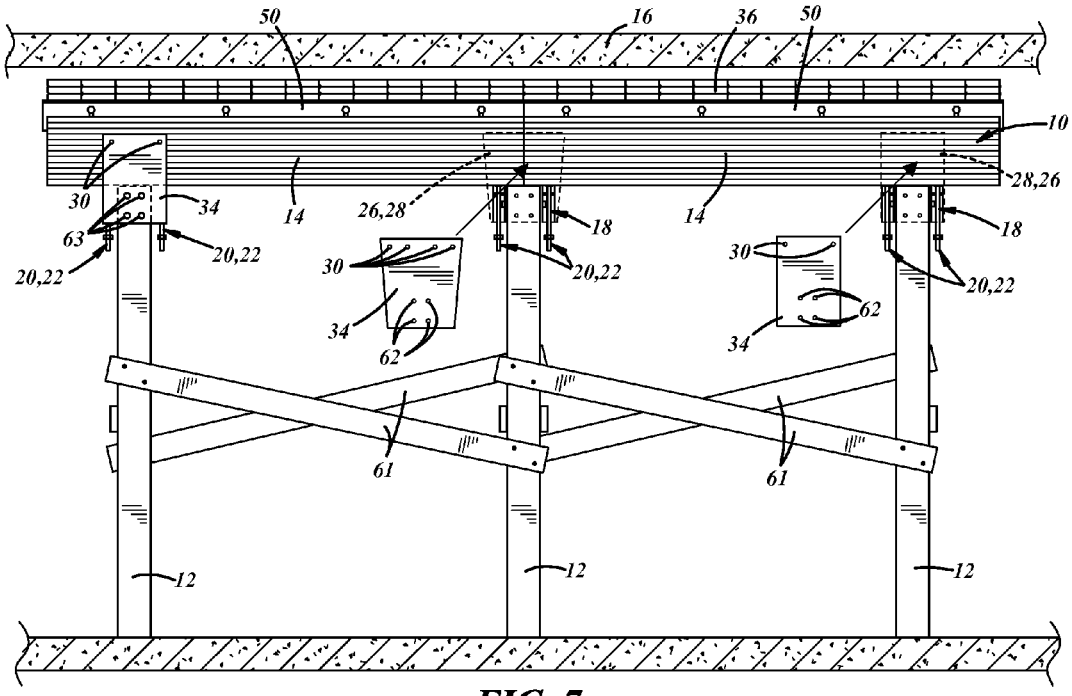
Figure 9:
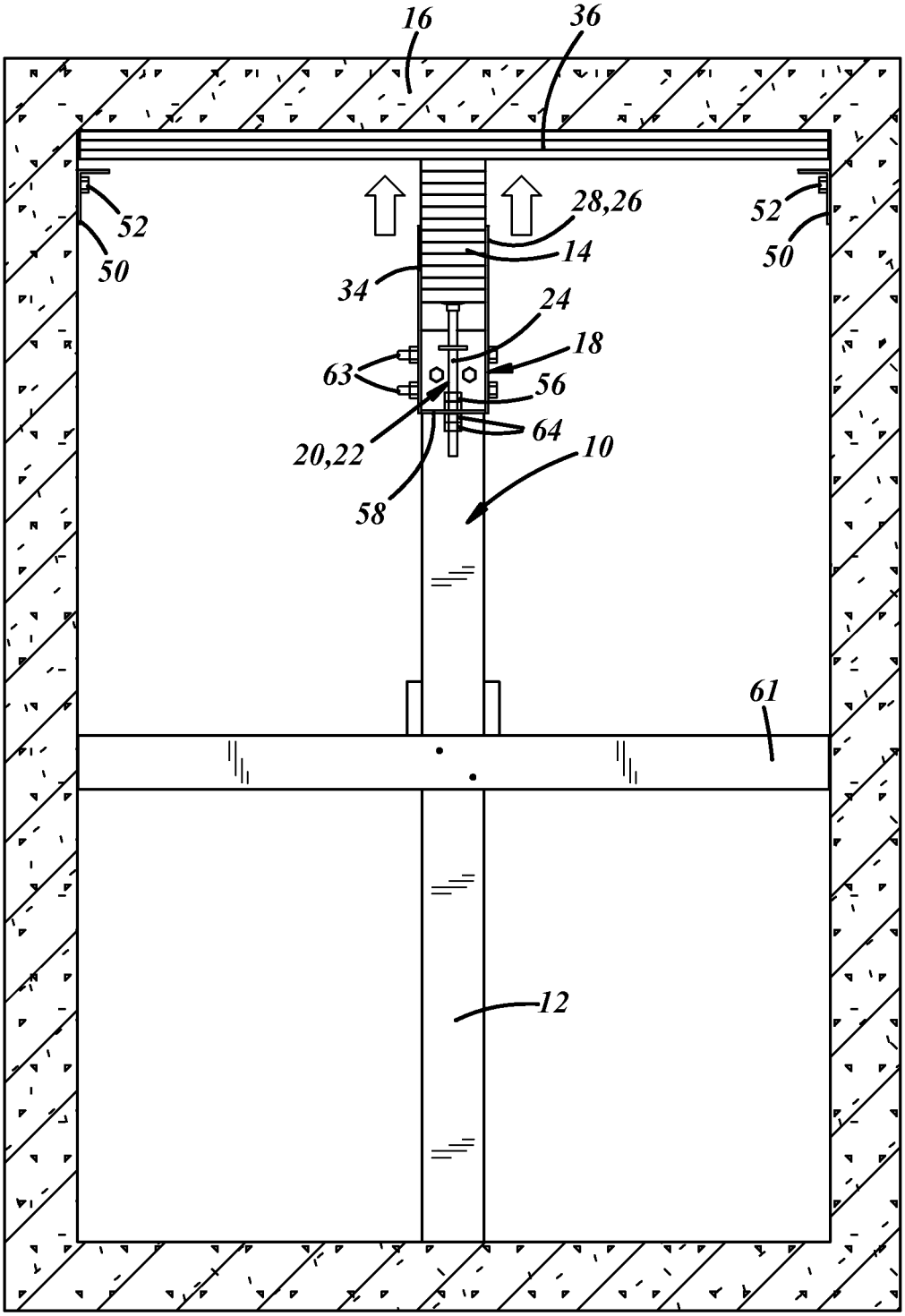
Figure 10:
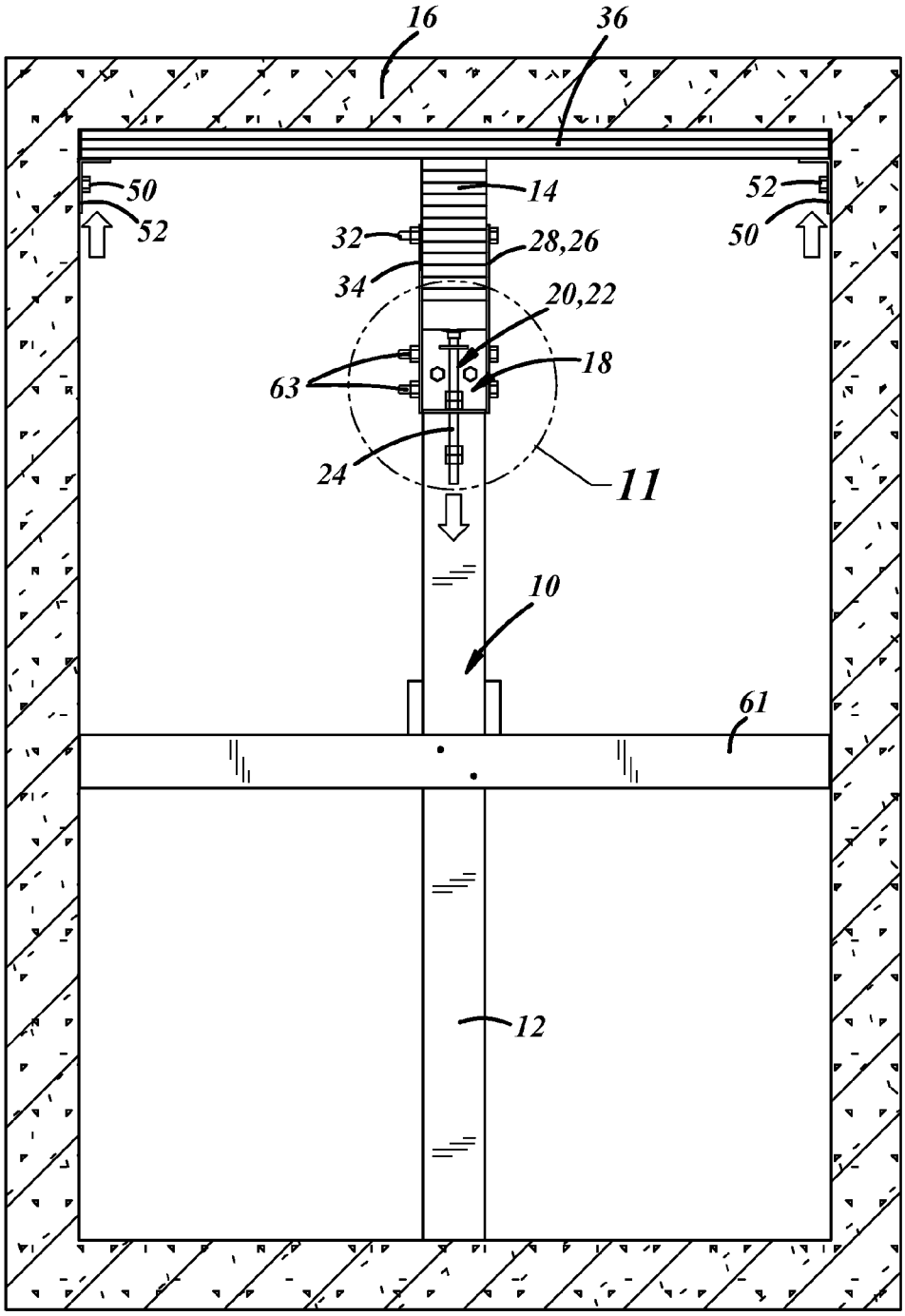
Figure 11:
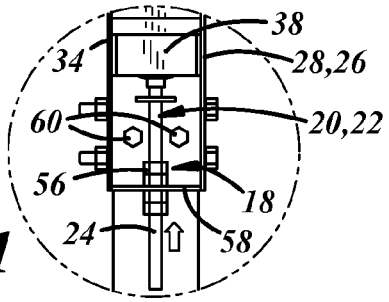
Figure 12:
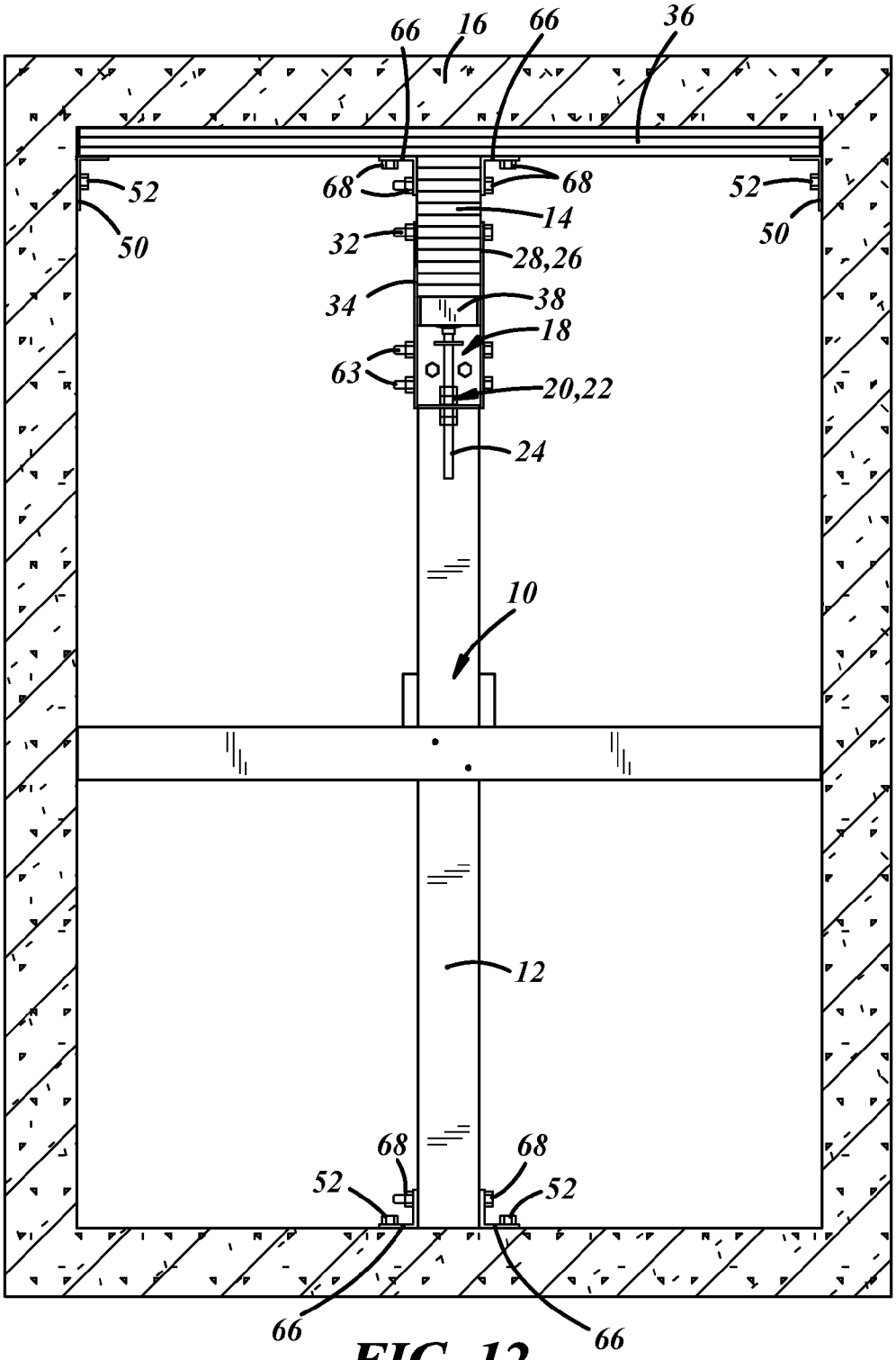
Figure 13:
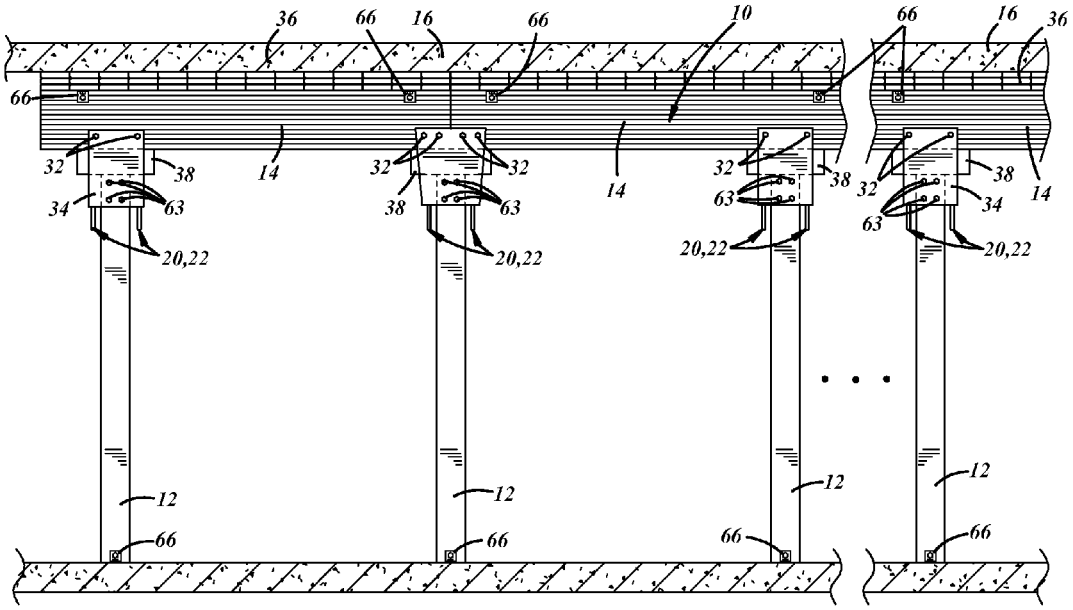
Figure 14:
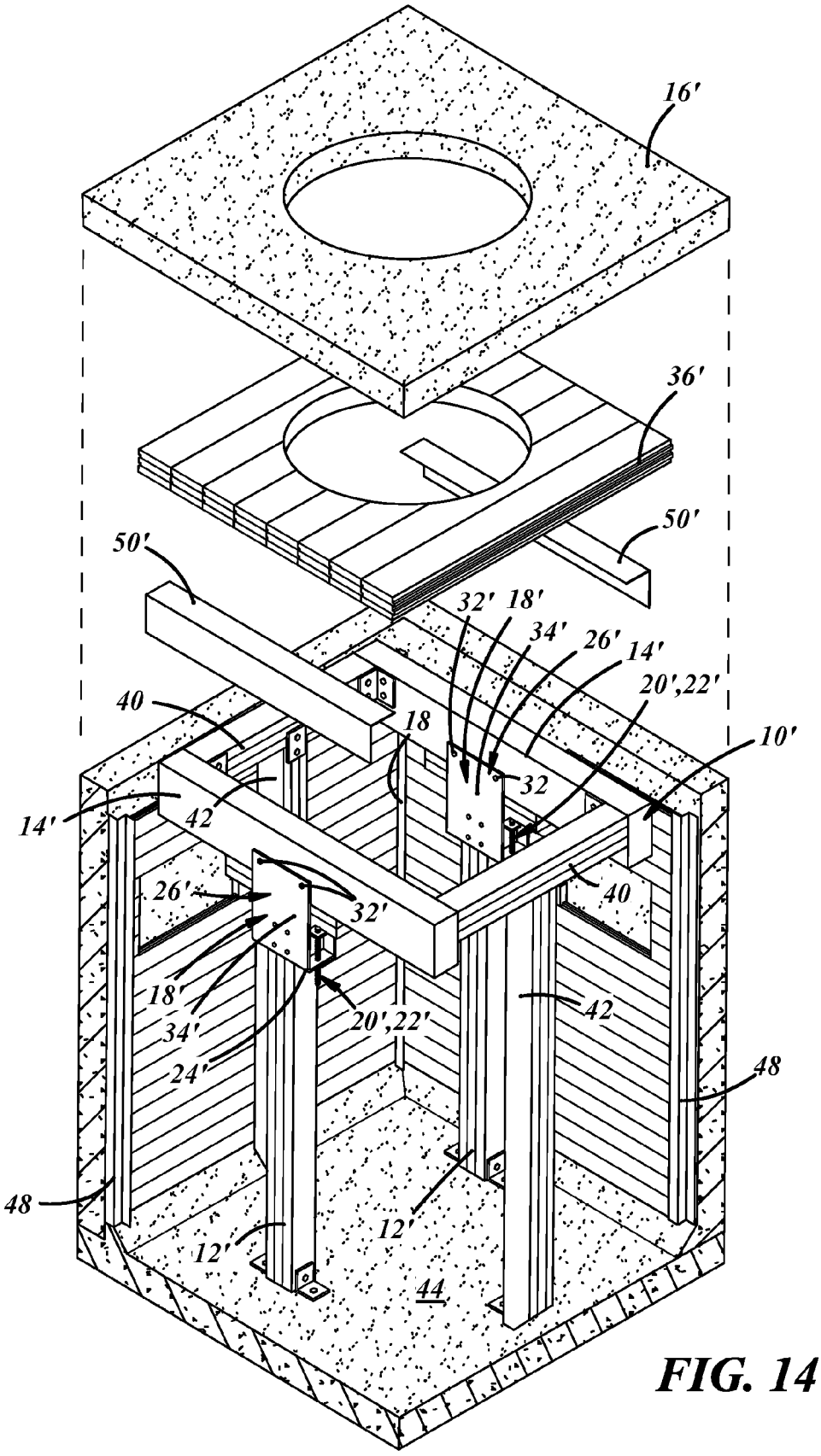
Figure 15:
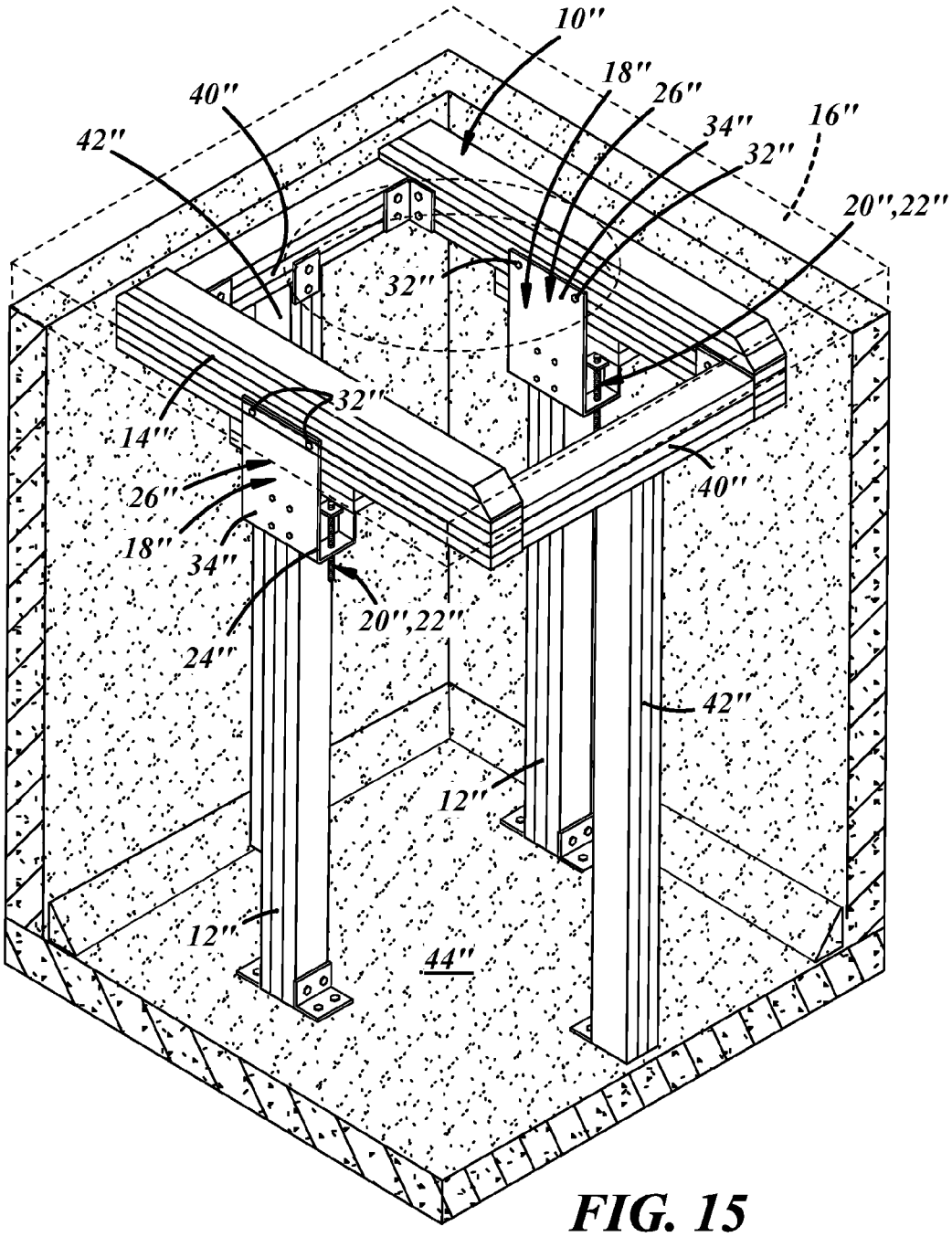

FIG. 7 is a front view of the shoring assembly showing decking supported on two ledger plates of the assembly and spaced below a vault roof, two crossbeam members supported on three column members of the assembly and spaced below the decking, three brackets carried by the three column members, respectively, threaded bolt assemblies of the brackets shown retracted such that the crossbeam members are resting on the column members, and further showing three side plates of the assembly, one of which is shown attached to one of the column members, and two of which are shown unattached;

FIG. 8 is a side end view of the shoring assembly of FIG. 7;

FIG. 9 is a side end view of the shoring assembly of FIG. 8 with the threaded bolt assemblies extended to lift the crossbeam members against the decking and the decking against the vault roof;

FIG. 10 is a side end view of the shoring assembly of FIG. 9 with the ledger plates move upward against the decking and fasteners connecting side plates and brackets of the assembly to crossbeams of the assembly;

FIG. 11 is a magnified view of the bracket, column member, and crossbeam member of FIG. 10, and shows a filler block of the assembly disposed between the column member and the crossbeam member;

FIG. 12 is a side end view of the shoring assembly of FIG. 10 with angle clips and fasteners shown joining a crossbeam member to decking of the assembly and a column member to a vault floor;

FIG. 13 is a front view of the shoring assembly of FIG. 7 showing the decking supported up against the vault roof by the ledger plates and crossbeam members, and the crossbeam members supported up against the decking by the three column members, the filler blocks, brackets and front plates of the assembly;

FIG. 14 is a perspective view of a second shoring assembly embodiment shown installed in a manhole vault; and FIG. 15 is a perspective view of a third shoring assembly embodiment shown installed in a manhole vault.

DETAILED DESCRIPTION

A first embodiment of a shoring assembly for supporting a reinforced concrete roof of an underground utility vault, is generally indicated at 10 in the drawings. A second embodiment is generally shown at 10' in FIG. 14. Reference numerals with the designation prime (') in FIG. 14 indicate alternative configurations of elements that also appear in the first embodiment. A third embodiment is generally shown at 10" in FIG. 15. Reference numerals with the double-prime (") designation in FIG. 15 indicate alternative configurations of elements that also appear in the second embodiment. Unless indicated otherwise, where a portion of the following description uses a reference numeral to refer to FIG. 1, that portion of the description applies equally to elements designated by primed numerals in FIG. 14 and double-primed numerals in FIG. 15; and where a portion of the description uses a reference numeral to refer to FIG. 14, that portion of the description applies equally to elements designated by double-primed numerals in FIG. 15.

Figure 1:
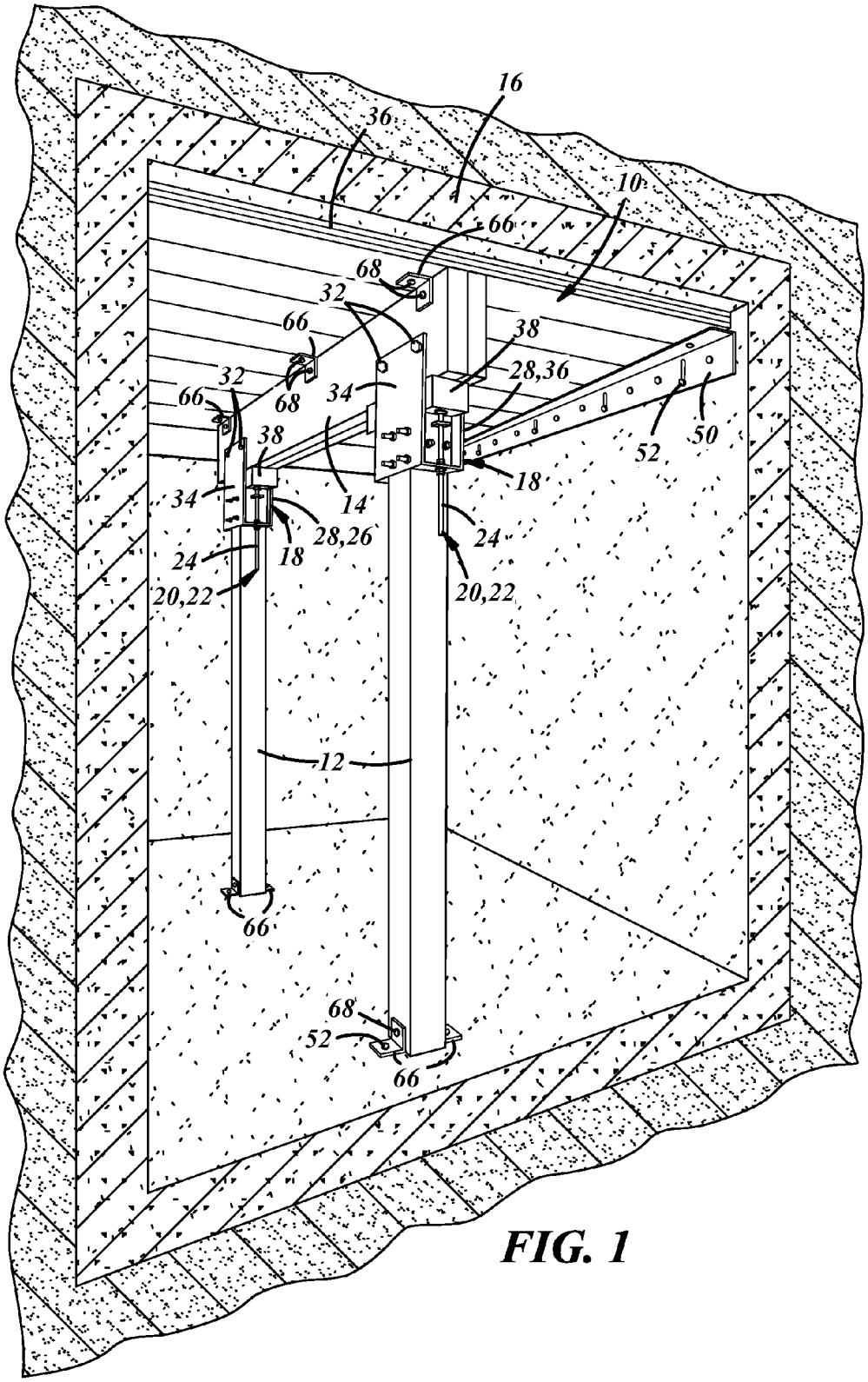
FIG. 1 is a perspective view of a shoring assembly shown installed in an underground utility vault.
Figure 4:
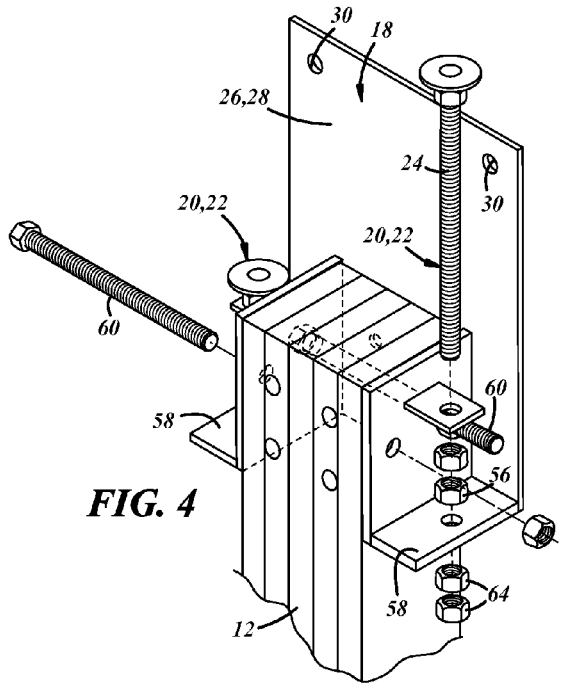
FIG. 4 is a perspective view of a bracket of the shoring assembly disposed on a column member of the assembly with one threaded bolt assembly of the bracket shown exploded, and further showing hardware for attaching the bracket to the column member.

As best shown in FIGS. 1, 7, 9, 10, 12, and 13, the assembly 10 may comprise an elongated column member 12 and an elongated crossbeam member 14 configured to be carried by the elongated column member 12 in an orientation generally parallel to a utility vault roof 16 to be shored and generally perpendicular to the column member 12. As best shown in FIGS. 1, 4, and 7, the assembly 10 may also comprise a bracket 18 that is connectable between the crossbeam member 14 and a top end of the column member 12 and that may be configured to support the crossbeam member 14 on the column member 12. The bracket 18 may comprise metal elements that are welded together and/or connected together by any other suitable means. One or more of the metal elements of the bracket 18 may comprise corrosion-resistant metal.

As best shown in FIG. 4, the bracket 18 may comprise a jack 20 adjustable to engage and raise the crossbeam member 14 relative to the column member 12 into a support position against a roof 16 of a vault to be shored. As is also best shown in FIG. 4, the jack 20 may comprise a threaded rod assembly 22 comprising a threaded rod 24 that is adjustable, i.e., alternately extendable and retractable relative to the bracket 18, using a standard open end wrench.

The bracket 18 may comprise a retainer 26 comprising an upwardly extending flat plate portion 28 that secondarily retains the crossbeam member 14 in the engaged position independent of jack engagement with the crossbeam member 14, i.e., whether or not the jack 20 is engaging and supporting the crossbeam member 14 on the bracket 18 and column member 12. As shown in FIGS. 4 and 7, the retainer 26 may comprise bracket through-holes 30 disposed in the flat plate portion 28 in respective positions to receive fasteners such as, for example, bolts 32, which engage the bracket 18 and the crossbeam member 14 such that the crossbeam member 14 is supported on the bracket 18 and fastened in place by the fasteners 32. Each retainer 26 may also comprise a side plate 34 that may be attached to the crossbeam member 14, the upper end of a column member 12, and the bracket 18, and disposed opposite the upwardly-extending flat plate portion 28 of the bracket 18 as shown in FIGS. 1, 7-11, and 13.

The assembly 10 may include two or more crossbeam members 14 and/or two or more column members 12, and brackets 18 supporting each of the crossbeam members 14 as shown in FIGS. 7 and 13. Column members 12 and brackets 18 supporting a crossbeam member 14 may be spaced apart along the crossbeam member 14 and may be oriented generally parallel to one another and/or perpendicular to the crossbeam member 14. As shown in FIG. 13, any number of crossbeam-column member combinations may be included in a system to accommodate any length of vault roof 16 to be shored.

As shown in FIGS. 1, 3, 7-10, 12, and 13, the assembly 10 may include decking 36 comprising lateral shoring members configured to be carried between the crossbeam member 14 and a vault roof 16 to be shored. The lateral shoring members of the decking 36 may be wood planks arranged edge-to-edge and oriented perpendicular to the crossbeam member 14. The decking 36 may include two or more layers of wood planks so arranged.

One or more of the members 12, 14 may comprise wood, and that wood may be a variety of wood that is naturally decay-resistant. The wood may additionally or alternatively be treated with a preservative.

One or more of the members 12, 14 may comprise laminated wood layers. The one or more of the members may also comprise adhesive layers between wood layers to bind the wood layers together.

As shown in FIGS. 1 and 10-12, filler blocks 38 may be disposed between the crossbeam members 14 and the column members 12 in respective positions supporting the crossbeam members 14 on the column members 12. Each filler block 38 may have a rectangular prism shape having a vertical dimension generally equal to or slightly less than a vertical distance between the crossbeam member 14 and the column member 12 between which the filler block 38 is to be inserted after the jack 20 has been adjusted to move the crossbeam member 14 upward relative to the column member 12 into a position against the roof 16 of the vault to be shored. In the present embodiment the filler blocks 38 comprise wood, but in other embodiments may comprise any suitable material or combinations of material. Preferably the material or materials that the filler blocks 38 comprise are selected to be easily formable or easy to cut into a shape that fits tightly into spaces left between the crossbeam members 14 and column members 12 after moving the crossbeam members 14 upward against the roof 16 of the vault to be shored, while at the same time being dimensionally stable enough to support the crossbeam members 14, and loads borne by the crossbeam members 14, on the column members 12.

As shown in FIG. 14, the second embodiment of the shoring assembly 10', which is adapted for shoring man-hole vaults, may include a second elongated column member 12', and a second elongated crossbeam member 14' configured to be carried by the second column member 12' in an orientation generally parallel to a utility vault roof to be shored, generally perpendicular to the second column member 12', and generally parallel to and spaced from the first crossbeam member 14'. Also according to the second embodiment, a second bracket 18' is connectable between the second crossbeam member 14' and the second column member 12' and configured to support the second crossbeam member 14' on the second column member 12'. The second bracket 18' may comprise a second jack 20' adjustable to move the second crossbeam member 14' upward relative to the second column member 12', whereby the second crossbeam member 14' can be raised against a roof 16' of a vault to be shored.

Further according to the second embodiment, first and second insert members 40 may be connectable between and positionable normal to the first and second crossbeam members 14'. As shown in FIG. 14, the first and second crossbeam members 14' and the first and second insert members 40 may be interconnected to form a box frame.

Also according to the second embodiment of FIG. 14, additional column members 42 may be connectable between the respective insert members 40 and a floor 44 of a vault to be shored. The second embodiment of the shoring assembly 10' may also include four wall board panels 46 configured to line sidewalls of the vault, and four elongated corner braces 48 configured to brace the wall board panels along their respective side edges into respective positions lining the sidewalls of the vault. The corner braces 48 may have Z-type cross-sections configured to brace adjacent wall board panel side edges against each other.

As shown in FIG. 15, the third embodiment of the shoring assembly 10", which is also adapted for shoring man-hole vaults, may omit decking and/or wall board panels.

Figure 2:
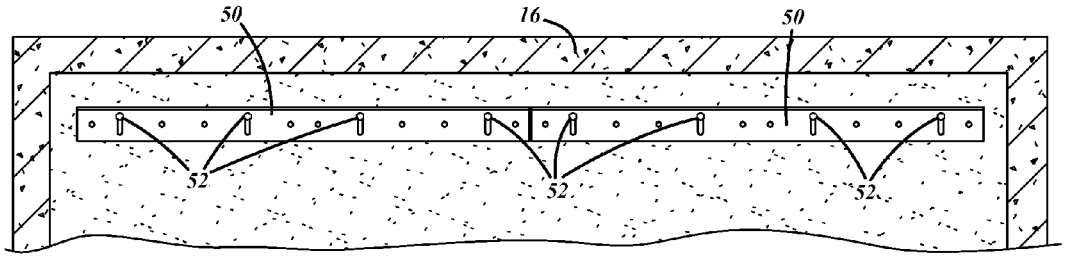
FIG. 2 is a front view of ledger plates of the shoring assembly, shown installed in a utility vault.

In practice, a utility vault roof 16 can be supported or shored by first marking and drilling holes in vault wall and loosely attaching ledger plates 50 to opposing vault walls with the ledger plates 50 resting on anchor bolts 52 as shown in FIG. 2.

Figure 3:
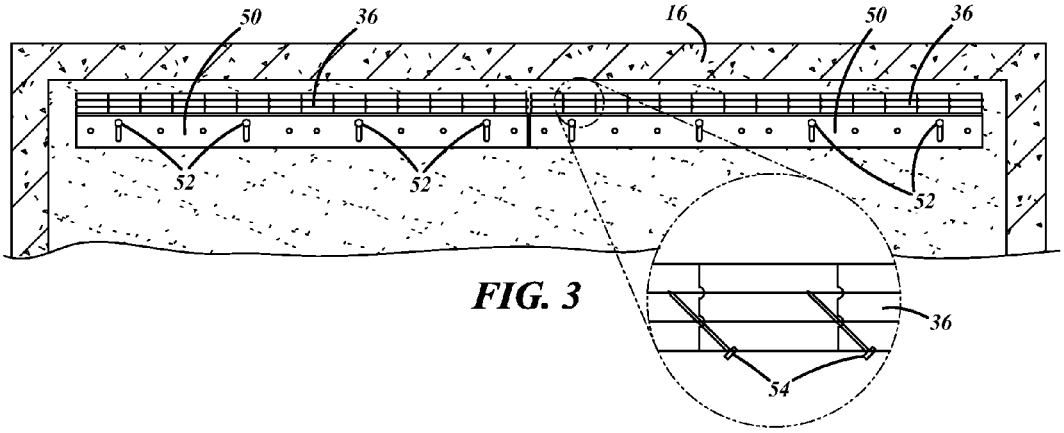
FIG. 3 is a front view of decking of the shoring assembly, supported on the ledger plates of FIG. 2.

As shown in FIG. 3, decking 36 may then be disposed on the ledger plates 50 and secured to one another using fasteners 54 such as screws.

Threaded rod assemblies 22 may then be installed in the brackets 18 as shown in FIG. 4. Upper hex nuts 56 may be threadedly engaged on threaded rods 24 of the threaded rod assemblies 22, above respective floor plates 58 of the brackets 18 so as to be engageable to extend and retract the threaded rods 24 relative to their respective brackets 18.

Figure 5:
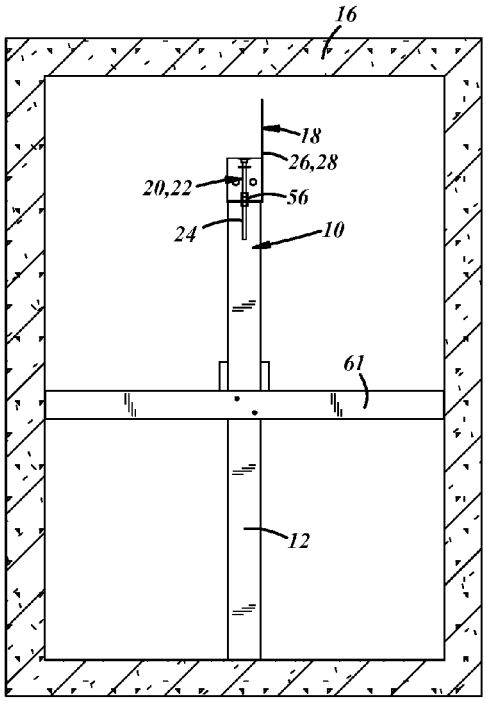
FIG. 5 is a side end view of a bracket of the assembly carried on a column member of the assembly, the column member being shown in a plumbed position within a utility vault, supported by temporary bracing.
Figure 6:
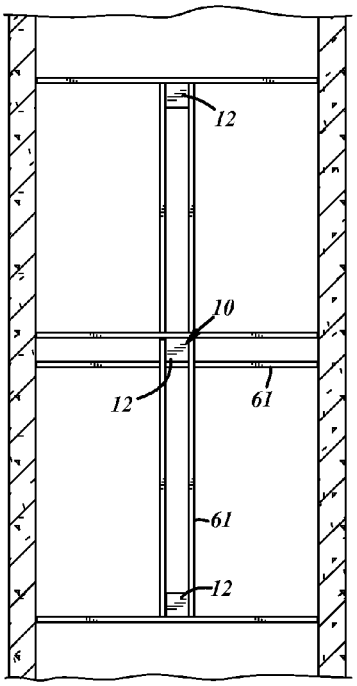
FIG. 6 is a top view of three columns of the shoring assembly in respective plumbed positions within a utility vault and supported by temporary bracing.

As shown in FIGS. 4 and 5, the brackets 18 may then mounted on the tops of respective column members 12 using, for example, two hex bolts 60 per column member 12.

All column members 12 may then be positioned and plumbed generally vertically and may be temporarily supported within the vault using temporary bracing 61 as shown in FIGS. 5-10, and 12.

Crossbeam members 14 may then be supported on the column members 12 in an orientations generally parallel to a roof of the utility vault, and generally perpendicular to the column members 12 as shown in FIGS. 7 and 8. The brackets 18 may be supported between the crossbeam members 14 and respective column members 12 such that the brackets 18 are supporting the crossbeam members 14 on the column members 12.

As is also shown in FIG. 7, side plates 34 may then be attached to respective upper ends of the column members 12 using fasteners 63 such as hex bolts passed through side plate lower through-holes 62 into the column members 12. Fasteners 32 may also be inserted through the upper through-holes 30 of the side plates 34 to extend into or through the crossbeam members 14. Side plates 34 attached to upper ends of column members 12 that support abutting ends of crossbeam members 14 may be shaped to accommodate additional upper through-holes, so that more than one fastener can engage each of the abutting crossbeam members 14.

As shown in FIG. 9, the crossbeam members 14 may then be moved upward relative to the column members 12 and either driven into contact with the vault roof 16, or caused to carry decking 36 into contact with the vault roof 16, by adjusting the jacks 20 of the brackets 18. More specifically, an open-end wrench may be used to engage and turn upper hex nuts 56 of the threaded rod assemblies 22 clockwise to raise the threaded rods 24 of the threaded rod assemblies 22 into engagement with the crossbeam members 14, and to raise the crossbeam members 14 (or decking 36) against the vault roof 16. As is also shown in FIG. 9, lower hex nuts 64 of the threaded rod assemblies 22 may then be tightened against respective bottom surfaces of the bracket base plates 58 to act as lock nuts and secure the rod assemblies against further rotation relative to the brackets 18.

After the crossbeam members 14 have been moved upward into contact with the vault roof 16, the crossbeam members 14 may, as shown in FIGS. 7 and 10, be secondarily retained in their respective support positions against the vault roof 16 by field drilling holes in the crossbeam members 14 through the side plate upper through-holes 30 and/or corresponding upper through-holes formed through the upwardly-extending plate portions 28 of the brackets 18, and then installing fasteners 32 such as hex bolts.

The ledger plates 50 may then be manually slid upward against the decking 36 and secured against the vault walls by tightening the anchor bolts 52 as shown in FIG. 10. As is also shown in FIG. 10, the jack 20 may then be retracted out of engagement with the crossbeam member 14 by using a wrench to retract the threaded rods 24 of the respective threaded rod assemblies 22.

The resulting vertical distances between the crossbeam members 14 and column members 12 may then be measured and filler blocks 38 shaped to have a vertical dimensions generally equal to the respective vertical distances. The filler blocks 38 may then be inserted between the crossbeam members 14 and the column members 12 as shown in FIGS. 11, and 12.

A wrench may be used to engage and rotate the upper hex nuts 56 of the threaded rod assemblies 22 to extend the threaded rods 24 of the threaded rod assemblies 22 against the filler blocks 38 to secure the filler blocks 38 against the crossbeam members 14. The threaded rods 24 of the threaded rod assemblies 22 may then be locked in place by turning the remaining hex nuts of the threaded rod assemblies 22.

As shown in FIG. 12, angle clips 66 and fasteners 52, 68 may then be used to attach the crossbeam members 14 to the roof 16, or, when decking 36 is used, the clips 66 and fasteners 68 may be used to attach the crossbeam members 14 to the decking 36. Clips 66 and fasteners 52, 68 may also be used to attach the column members 12 to the vault floor. The temporary bracing 61 may then be removed from the column members 12. Steel anchor bolts 52 may be used to fasten the angle clips to concrete vault floors and roofs, and hex bolts 68 may be used to fasten the angle clips to the crossbeam and column members 12, 14 and to decking 36 when disposed between the crossbeam members 14 and the vault roof 16.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A shoring assembly for supporting a utility vault roof, the assembly comprising:

an elongated column member;

an elongated crossbeam member carried by the elongated column member in an orientation generally perpendicular to the column member and generally parallel to a utility vault roof to be shored;

a bracket connected between the crossbeam member and the column member adjacent a top end of the column member and supporting the crossbeam member on the column member, the bracket comprising a jack member that is extendable upward to engage and move the crossbeam member upward relative to the column member into a support position against a vault roof to be shored, the bracket comprising a retainer that holds the crossbeam member in the support position while the jack member is retracted to a retracted position in which an uppermost end of the jack member is disposed at or below the level of the top end of the column member; and a filler block insertable into and shaped to fill a gap between the crossbeam member and the top end of the column member when the retainer is holding the crossbeam member in the support position and the jack member is in the retracted position.

2. The shoring assembly of claim 1 in which the jack member comprises a threaded rod assembly.

3. The shoring assembly of claim 2 in which the threaded rod assembly is configured to be alternately extendable and retractable using a standard open end wrench.

4. The shoring assembly of claim 1 in which the container comprises a bracket through-hole disposed in a position to receive a fastener engaging the bracket and the crossbeam member such that the crossbeam member is supported on the bracket by the fastener.

5. The shoring assembly of claim 1 in which the bracket comprises metal elements connected together.

6. The shoring assembly of claim 1 in which the filler block is shaped to have a vertical dimension generally equal to a vertical distance between the crossbeam member and the top end of the column member with the crossbeam member in the support position against the roof of the vault to be shored.

7. The shoring assembly of claim 1 in which the filler block comprises wood.

8. The shoring assembly of claim 1 in which the assembly includes two or more columns and two or more brackets supporting the crossbeam member on the two or more columns, the two or more columns and two or more brackets being spaced apart along the crossbeam member.

9. The shoring assembly of claim 1 in which the assembly includes lateral shoring members carried between the crossbeam member and a vault roof to be shored.

10. The shoring assembly of claim 1 in which the assembly includes decking configured to be carried between the crossbeam member and a vault roof to be shored.

11. The shoring assembly of claim 1 in which one or more of the column members comprises laminated wood layers.

12. The shoring assembly of claim 11 in which one or more of the column members comprises adhesive layers between the wood layers.

13. The shoring assembly of claim 1 in which:

the bracket includes a flat plate portion extending upwardly along a first side of the crossbeam and;

the assembly includes a side plate portion attachable to the column and crossbeam members in a position extending upwardly along a side of the crossbeam opposite the first side of the crossbeam and opposite and generally parallel to the flat plate portion of the bracket.

14. The shoring assembly of claim 13 in which the retainer comprises a bracket through-hole disposed in one of the flat plate portion or side plate portion in a position to receive a fastener engaging the bracket and the crossbeam member such that the crossbeam member is supported on the bracket by the fastener.

15. A method for shoring a utility vault roof, the method comprising steps of:

positioning an elongated column member generally vertically within a utility vault to be shored;

supporting an elongated crossbeam member on the column member in an orientation generally parallel to a roof of the utility vault, and generally perpendicular to the column member;

supporting a bracket between the crossbeam member and the column member such that the bracket is supporting the crossbeam member on the column member;

moving the crossbeam member upward relative to the column member and into contact with the roof of a vault by adjusting a jack member of the bracket; and inserting a filler block between the crossbeam member and the column member following the step of moving the crossbeam member upward into contact with the roof of the vault and while the bracket continues to support the crossbeam member on the column member.

16. The method of claim 15 including the additional step, before the inserting step, of shaping the filler block to have a vertical dimension generally equal to a vertical distance between the crossbeam member and the column member after the step of moving the crossbeam member upward relative to the column member into a support position against the roof of the vault to be shored.

17. The method of claim 15 including the additional steps, before the inserting step, of:

secondarily retaining the crossbeam member in the support position; and retracting the jack member out of engagement with the crossbeam member.

18. The method of claim 15 including the additional step of attaching a side plate to the column and crossbeam members following the step of moving the crossbeam member upward relative to the column member and into contact with the roof of a vault.

* * * * *